US010372080B2

(12) United States Patent
Adaniya et al.

(10) Patent No.: US 10,372,080 B2
(45) Date of Patent: Aug. 6, 2019

(54) IMAGE FORMING APPARATUS HAVING A BLOCKING MEMBER THAT CHANGES A WIDTH OF AN OPENING OF AN AIR BLOW PORTION

(71) Applicant: CANON KABUSHIKI KAISHA, Tokyo (JP)

(72) Inventors: Makoto Adaniya, Matsudo (JP); Satoshi Murasaki, Numazu (JP); Hiroyuki Yamano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/987,124

(22) Filed: May 23, 2018

(65) Prior Publication Data

US 2018/0341218 A1 Nov. 29, 2018

(30) Foreign Application Priority Data

May 25, 2017 (JP) ..... 2017-103432

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 15/2042* (2013.01); *G03G 2215/00421* (2013.01)

(58) Field of Classification Search
CPC ..... G03G 21/206; G03G 15/2017; G03G 2221/1645; G03G 2215/00421
See application file for complete search history.

(56) References Cited

U.S. PATENT DOCUMENTS 8,725,025 B2 5/2014 Murasaki
8,995,860 B2 * 3/2015 Akiya ..... G03G 21/206 399/334
9,025,989 B2 5/2015 Murasaki
2007/0059012 A1 * 3/2007 Tomine ..... G03G 399/69 399/69
2007/0059023 A1 * 3/2007 Koshida ..... G03G 15/6573 399/92
2007/0280721 A1 * 12/2007 Kanai ..... G03G 15/6573 399/92
2012/0076510 A1 * 3/2012 Mizuno ..... G03G 15/20 399/12

(Continued)

FOREIGN PATENT DOCUMENTS

JP 2008003141 A 1/2008

*Primary Examiner* — Ryan D Walsh
(74) *Attorney, Agent, or Firm* — Venable LLP

(57) ABSTRACT

An image forming apparatus includes a fixing device having a nip, in which an image is fixed on a recording material, and an air blowing unit configured to feed air. A first blow portion is provided, through which the air fed by the air blowing unit flows toward a first area, which is an end portion of the fixing device, in a longitudinal direction of the fixing device, so as to cool the first area by the air via an opening of the first blow portion. A blocking member changes a width of the opening of the first blow portion, and a second blow portion is provided, branched from the first blow portion so as to cross the first blow portion, through which the air blocked by the blocking member flows toward a second area, which is a region in which the recording material passes through the nip.

7 Claims, 15 Drawing Sheets

A-A

(56) References Cited

U.S. PATENT DOCUMENTS

| | | | | |
|---|---|---|---|---|
| 2012/0282002 | A1* | 11/2012 | Murasaki | G03G 15/2017 399/329 |
| 2012/0308256 | A1* | 12/2012 | Suzuki | G03G 15/2042 399/92 |
| 2013/0051835 | A1* | 2/2013 | Kubo | G03G 15/2028 399/92 |
| 2014/0161481 | A1* | 6/2014 | Udagawa | G03G 21/206 399/92 |
| 2016/0223962 | A1* | 8/2016 | Kataoka | G03G 21/1633 |
| 2017/0090417 | A1* | 3/2017 | Yoshioka | G03G 21/206 |
| 2018/0150025 | A1* | 5/2018 | Egi | G03G 15/6529 |

* cited by examiner

IMAGE FORMING APPARATUS HAVING A BLOCKING MEMBER THAT CHANGES A WIDTH OF AN OPENING OF AN AIR BLOW PORTION

This application claims the benefit of Japanese Patent Application No. 2017-103432, filed May 25, 2017, which is hereby incorporated by reference herein in its entirety.

FIELD OF THE INVENTION AND RELATED ART

The present invention relates to an image forming apparatus, such as a copying machine and a printer, that employs an electrophotographic image forming method, an electrostatic image recording method, or the like.

In an image forming apparatus, an unfixed toner image is fixed to a sheet of recording medium. As a method for fixing an unfixed toner image to a sheet of recording medium, a thermal fixing method has been widely known that melts the toner particles, of which an unfixed toner image is formed, by heating the unfixed toner image. If a substantial number of sheets of recording medium, which are narrower than the widest sheet of recording medium conveyable through a fixing apparatus that employs the thermal fixing method, are conveyed through the fixing apparatus in succession, the out-of-sheet-path portions of the rotational fixing member of the fixing apparatus (portions of rotational fixing member that are outside recording medium path) excessively increase in temperature, which, in turn, possibly causes the toner on the sheet of recording medium to offset (hot offset), and/or the structural components of the apparatus to deteriorate.

In the case of the fixing apparatus disclosed in Patent Document 1, it is provided with a shutter unit made up of a combination of a fan and shutters. The shutter unit is structured so that the shutters are movable in the lengthwise direction of the fixing apparatus, according to the size (width) of a sheet of recording medium in terms of the lengthwise direction of the apparatus, making it possible for the cooling air outlet to be adjusted in dimension in terms of the lengthwise direction of the fixing apparatus, in order to prevent the out-of-sheet-path portions of the fixing apparatus from undesirably increasing in temperature, regardless of sheet size.

As an image forming apparatus is increased in speed, it sometimes occurs that when two (or more) prints are continuously produced, the following (i.e., subsequent) print is discharged into a delivery tray before the preceding print in the delivery tray cools down, and, therefore, the adhesiveness of the melted toner on the sheet of the preceding print causes the two sheets (i.e., prints) to adhere to each other. As for the technology to prevent two consecutively made prints from being adhered to each other by the melted toner, it has been known to employ a fan to air-cool each print (sheet of recording medium) as it comes out of the fixing device.

According to some of the conventional technologies that employ a fan to air-cool a print (sheet of recording medium) as the print comes out of the fixing device, an image forming apparatus is structured so that a shutter can be positioned (partially opened) to block a portion of the airflow generated by the fan (Japanese Laid-open Patent Application No. 2008-003141). This structural arrangement, however, has not been successful to efficiently utilize the airflow provided by the fan.

Further, providing an image forming apparatus with an additional fan to cool each sheet of recording medium as the sheet is discharged into a delivery tray suffers a problem similar to the problem described above.

Therefore, the primary object of the present invention is to provide an image forming apparatus that can not only prevent the portions of a fixing member that are outside the recording medium path from undesirably increasing in temperature, but also can efficiently cool a sheet of recording medium as the sheet is discharged into a delivery tray, regardless of its size in terms of the lengthwise direction of the fixing device.

SUMMARY OF THE INVENTION

According to one aspect, the present invention provides an image forming apparatus comprising an image forming portion configured to form an image on a recording material, a fixing device having a nip configured to fix the image on the recording material while nipping and feeding the recording material carrying the image, air blowing means configured to feed air for cooling a first area, which is an end portion area, with respect to a longitudinal direction of the fixing device, of a fixing member constituting the nip, a blocking member configured to change a width of an opening through which the air fed by the air blowing means flows, a first blow portion through which the air fed by the air blowing means toward the opening, a second blow portion through which the air from the air blowing means toward a second area, which is a region in a widthwise direction of the recording material passed through the nip flows, and a third blow portion through which the air from the air blowing means toward a third area that is closer to an end in the widthwise direction of the recording material passed through the nip flows, wherein the third blow portion is disposed at a position to take the air blocked by the blocking member.

Further features of the present invention will become apparent from the following exemplary embodiments with reference to the attached drawings.

Figure 2:
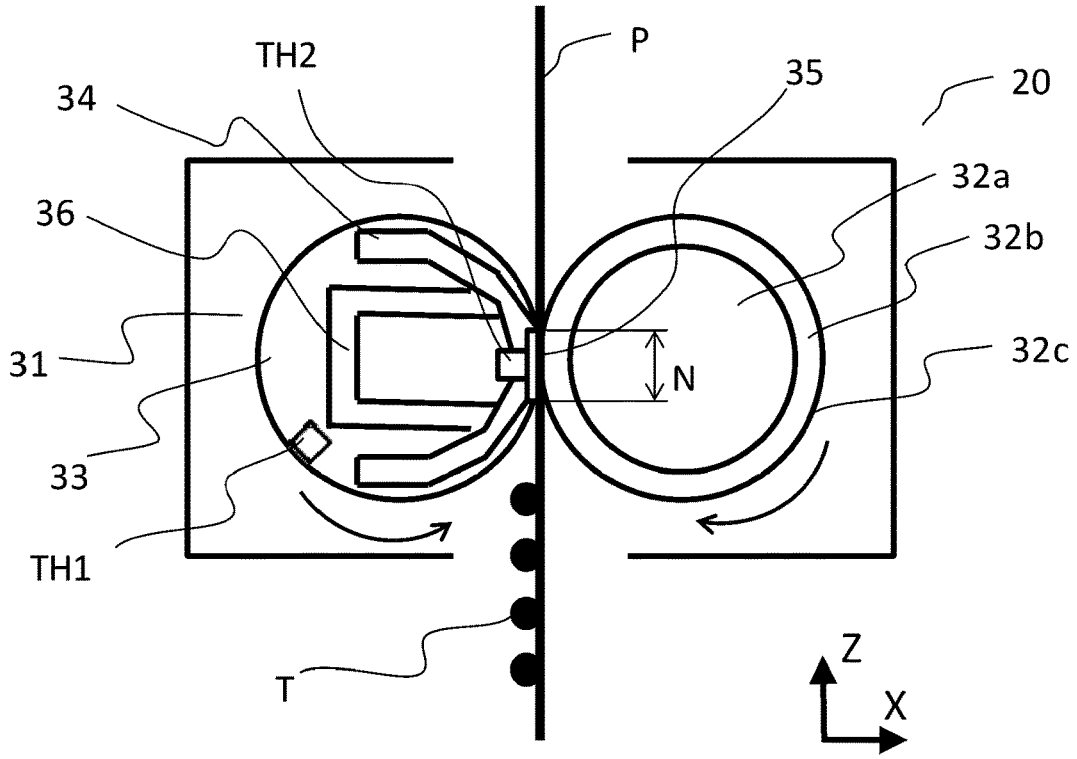
FIG. 2 is a sectional view of the fixing apparatus mounted in the image forming apparatus shown in FIG. 1, and is for showing the general structure of the fixing apparatus.
Figure 3:
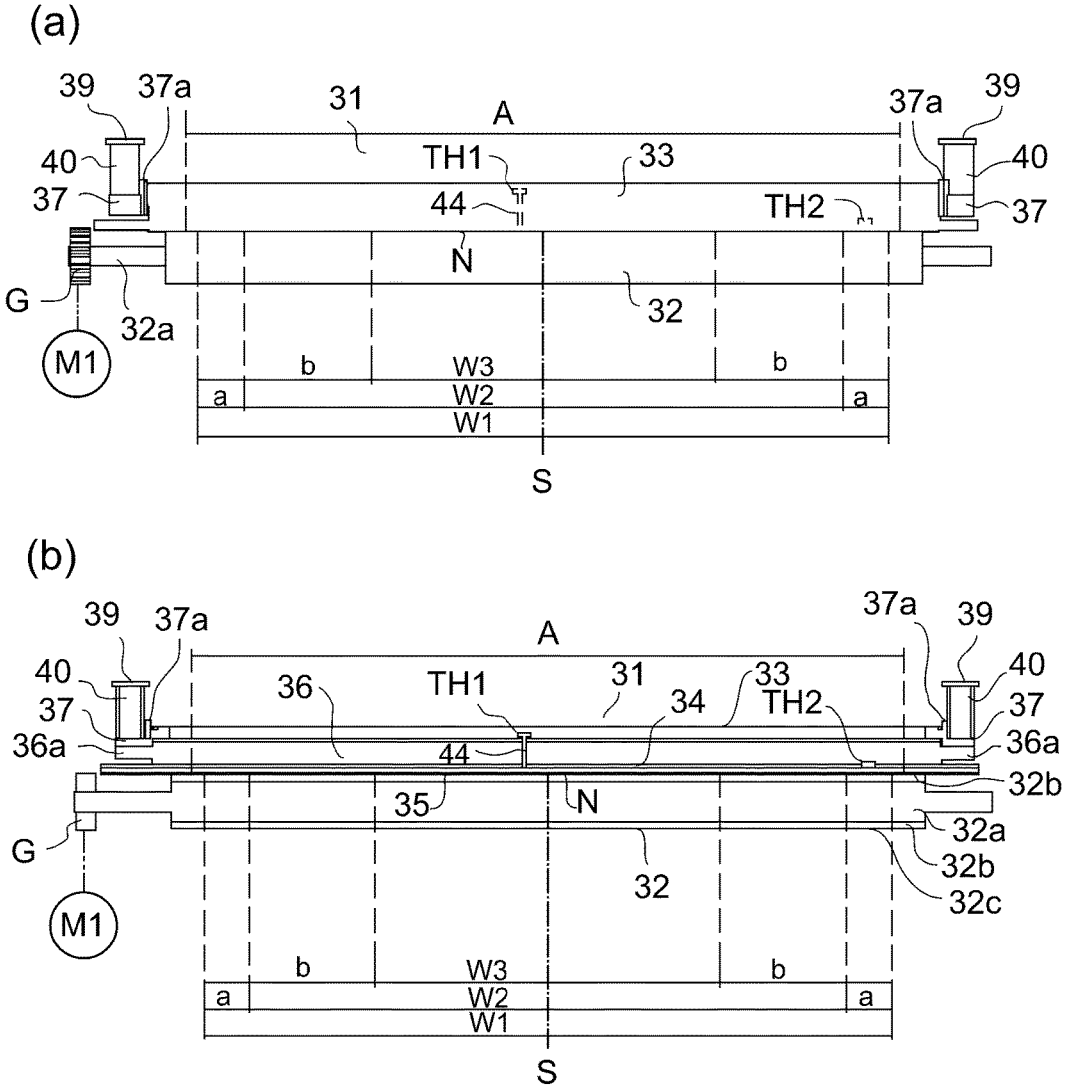

Part (a) of FIG. 3 is a schematic front view of a fixation mechanism portion of the fixing apparatus shown in FIG. 2, and part (b) of FIG. 3 is a schematic sectional view of the fixation mechanism portion of the fixing apparatus, at the vertical plane that coincides with the axial line of the pressure roller of the fixing apparatus, as seen from the front side of the apparatus.

Figure 4:
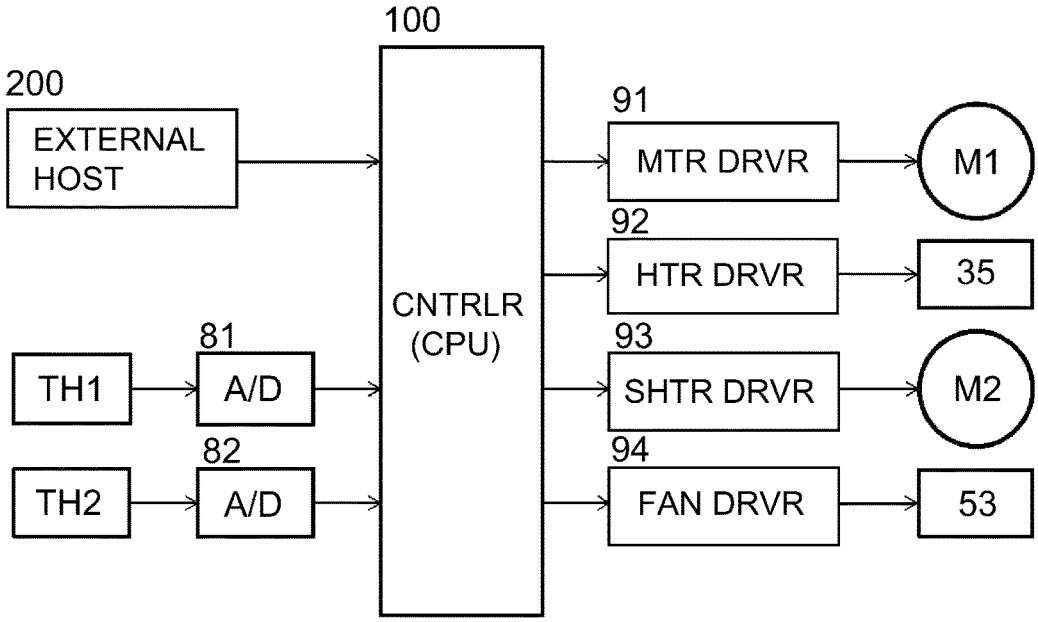

FIG. 4 is a block diagram of the control system of the image forming apparatus.

Figure 1:
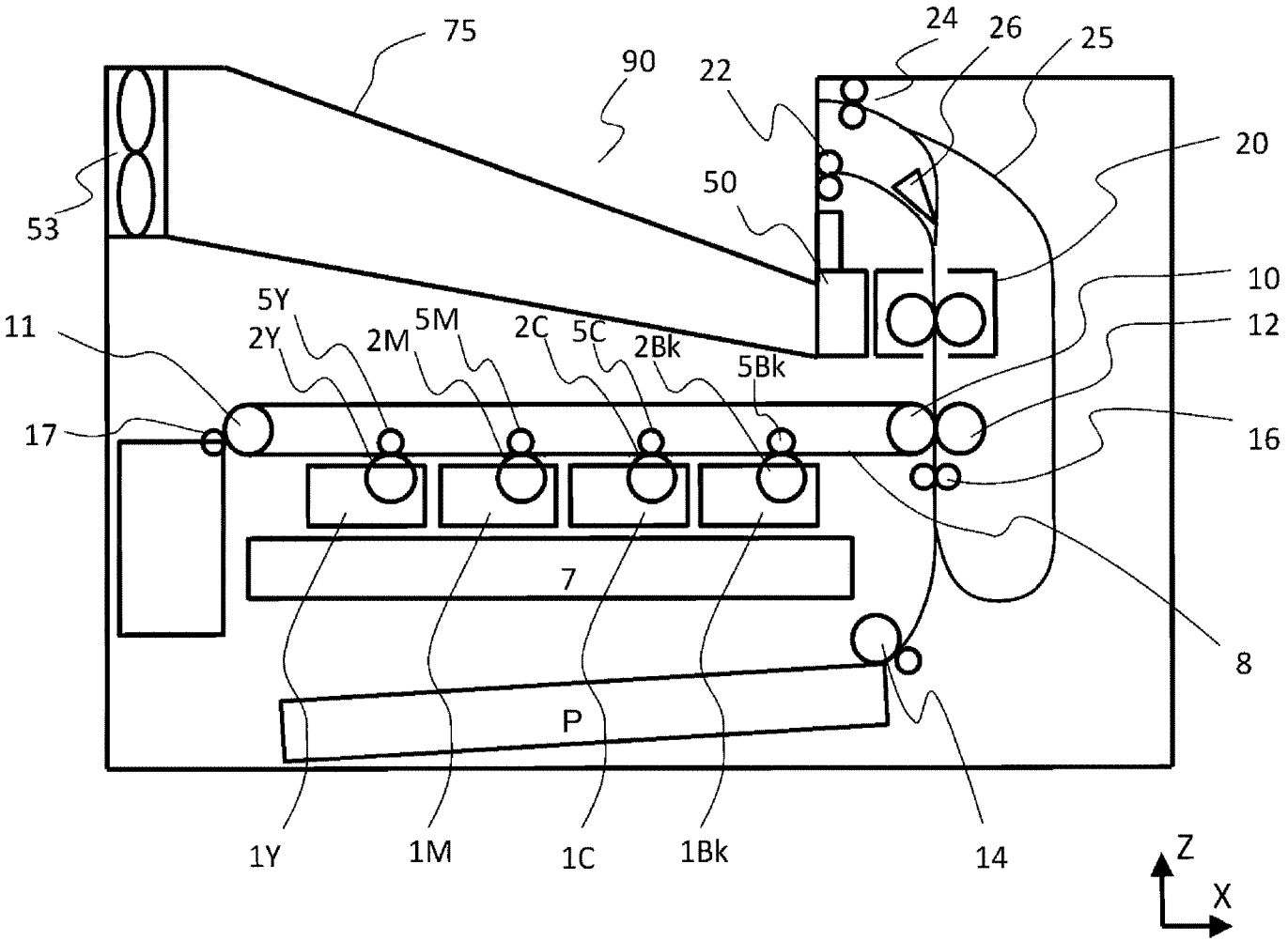
FIG. 1 is a sectional view of the image forming apparatus in one of the preferred embodiments of the present invention.
Figure 5:
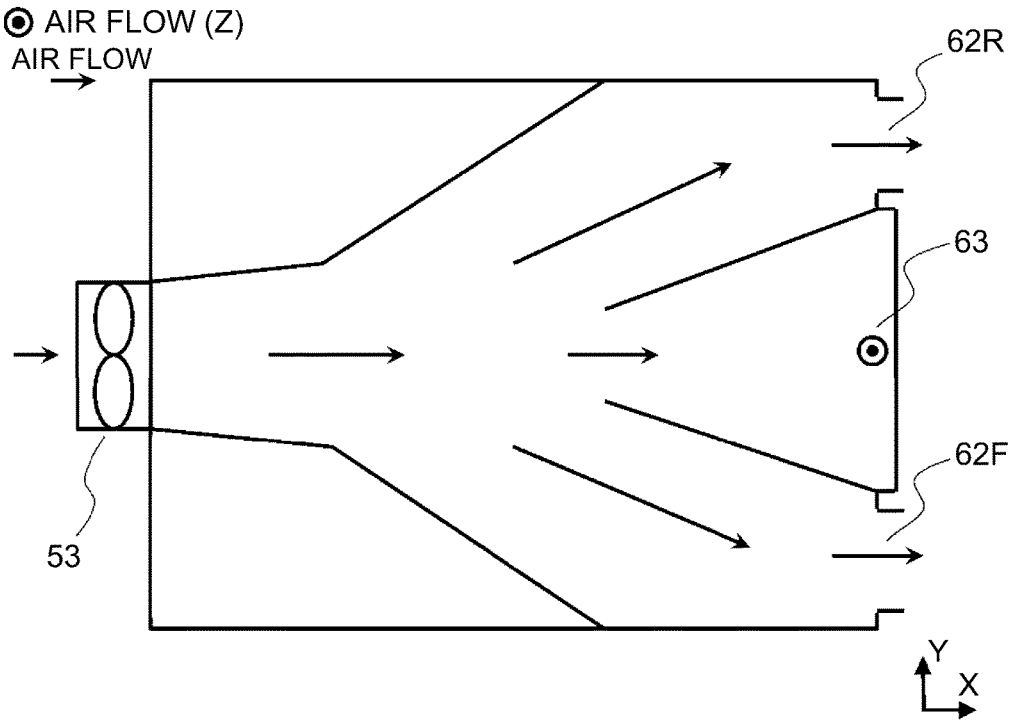

FIG. 5 is a schematic drawing of a combination of the delivery tray of the image forming apparatus shown in FIG. 1, and the airflow (air paths) in the tray.

Figure 6:
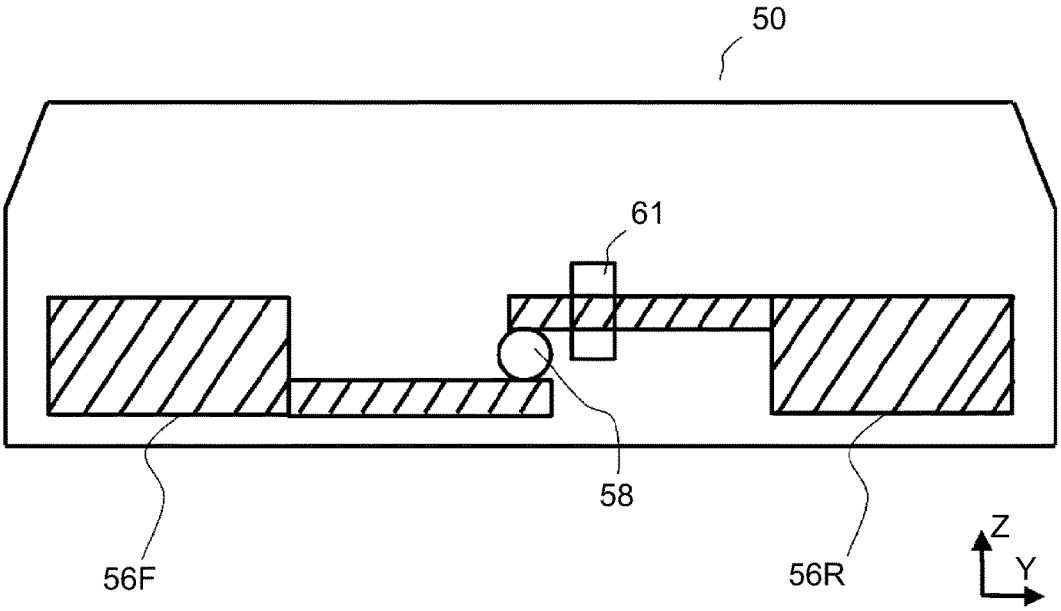

FIG. 6 is a schematic drawing of the shutter unit, as seen from the fixing apparatus side, when a shutter of the shutter unit is completely shut.

Figure 7:
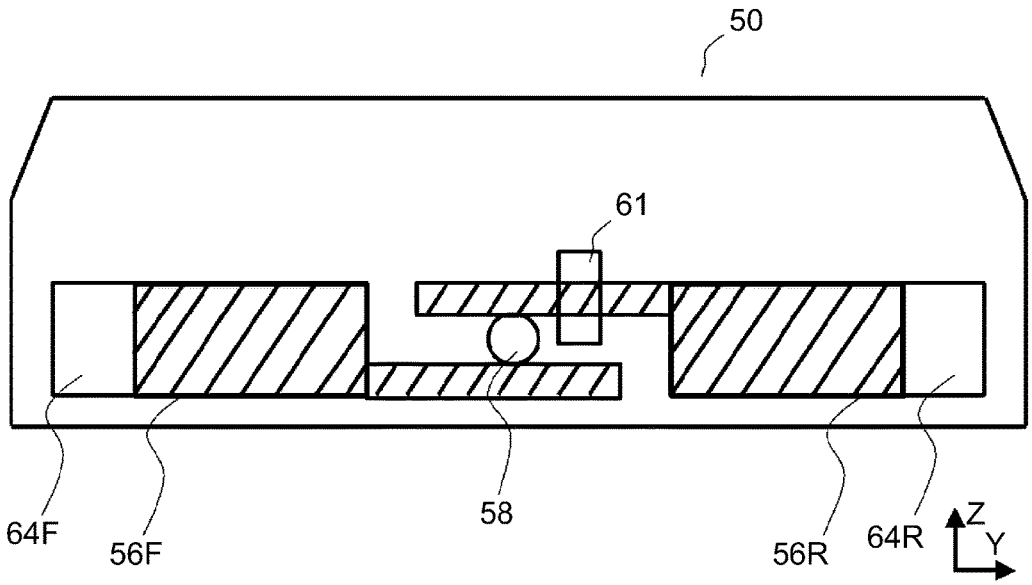

FIG. 7 is a schematic drawing of the shutter unit, as seen from the fixing apparatus side, when the shutter is open.

Figure 8:
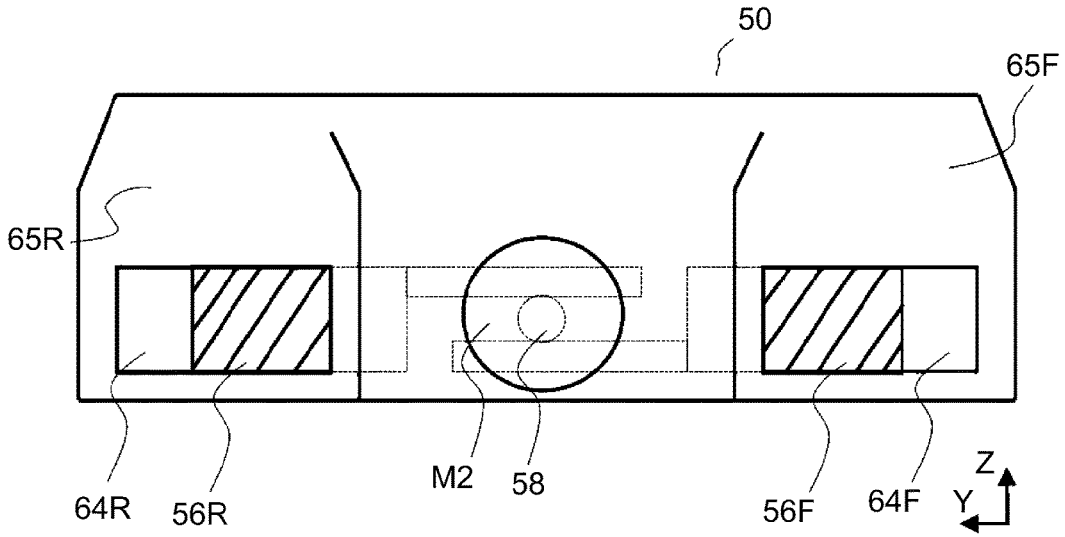

FIG. 8 is a schematic drawing of the shutter unit, as seen from the delivery tray side, when the shutter is open.

Figure 9:
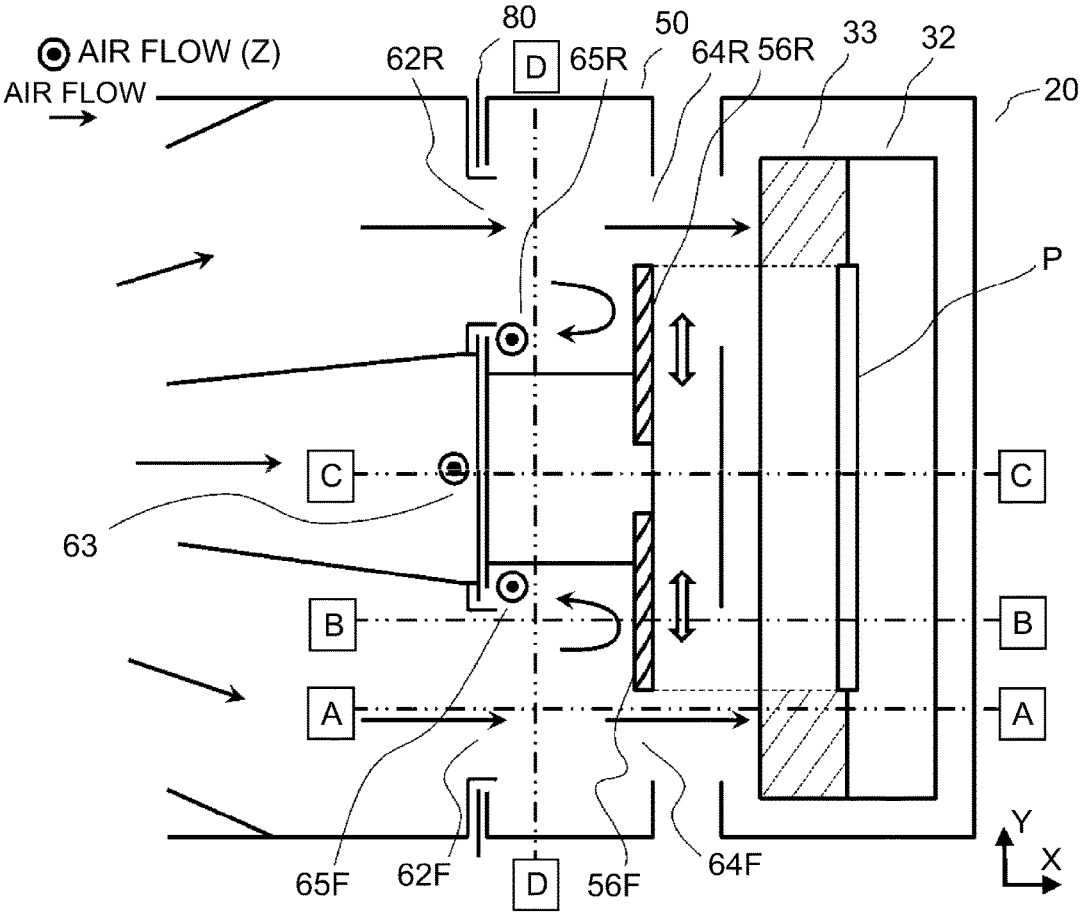

FIG. 9 is a schematic sectional view of a combination of the fixation mechanism portion, the shutter unit, and a portion of the delivery tray, at a plane that is perpendicular to the direction Z in FIG. 8, when the shutter is completely shut, and shows the airflow (air paths) from the delivery tray to the fixing apparatus.

Figure 10:
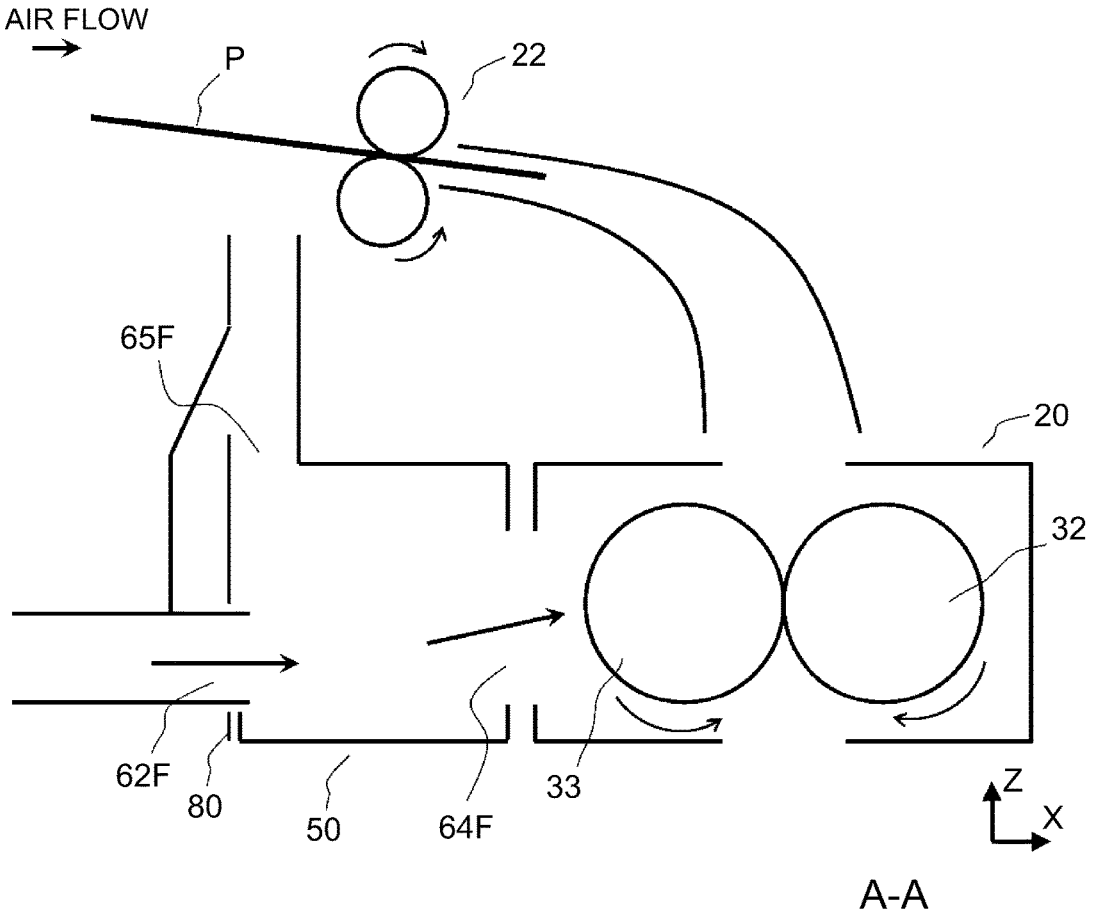

FIG. 10 is a schematic sectional view of a combination of the fixation mechanism portion, the shutter unit, and a portion of the delivery tray, at a plane A-A in FIG. 9.

Figure 11:
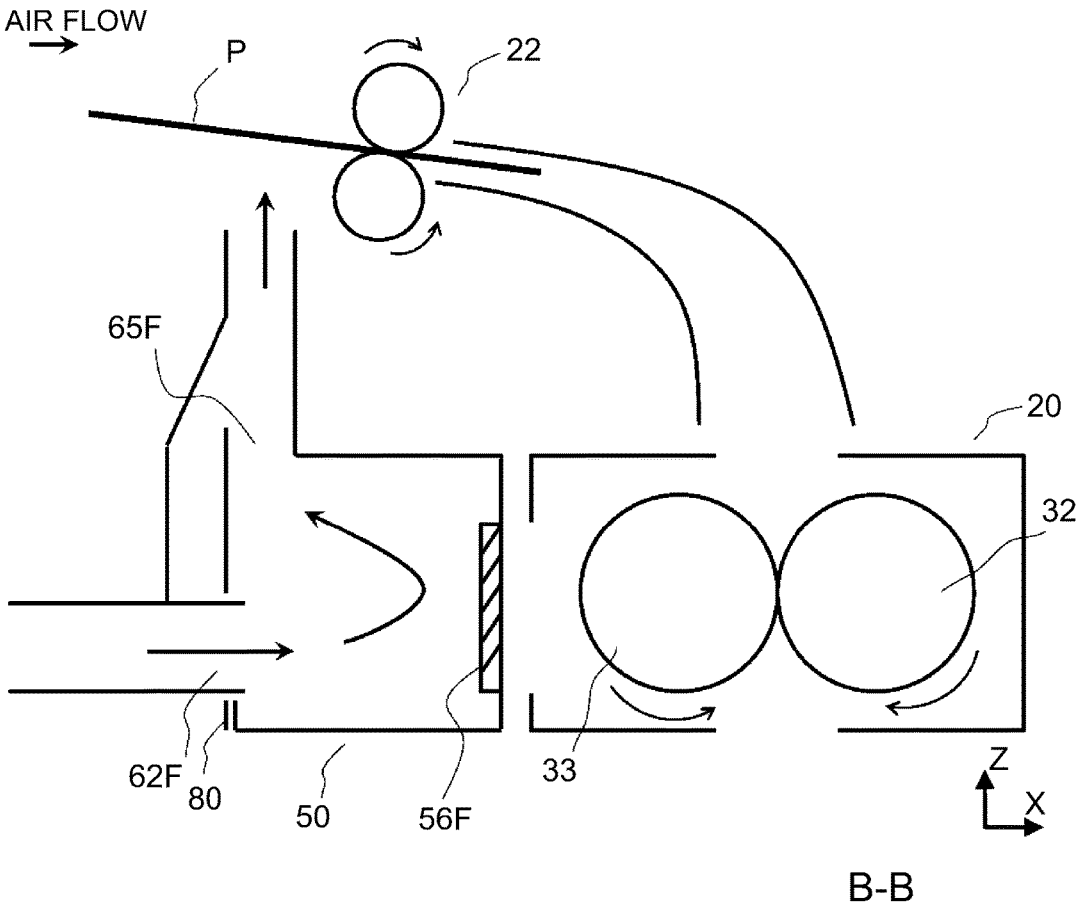

FIG. 11 is a schematic sectional view of the combination shown in FIG. 9, at a plane B-B in FIG. 9.

Figure 12:
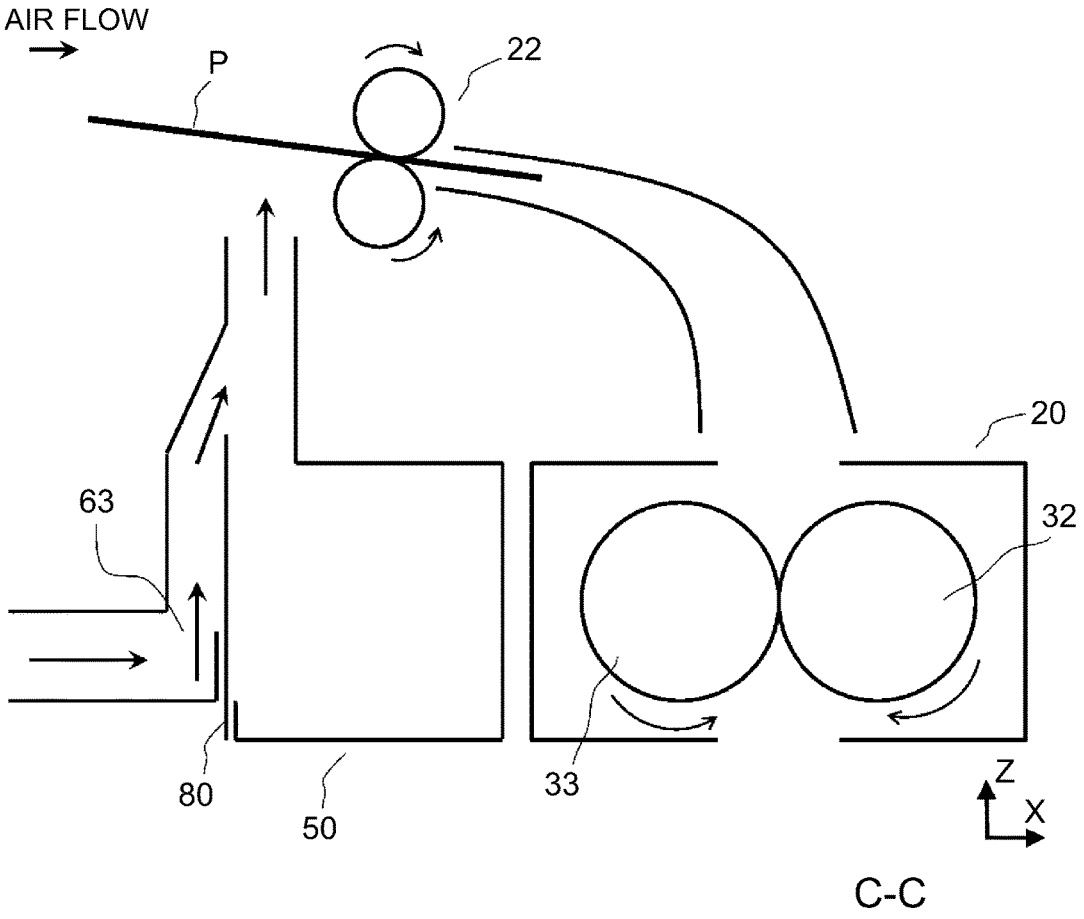

FIG. 12 is a schematic sectional view of the combination shown in FIG. 9, at a plane C-C in FIG. 9.

Figure 13:
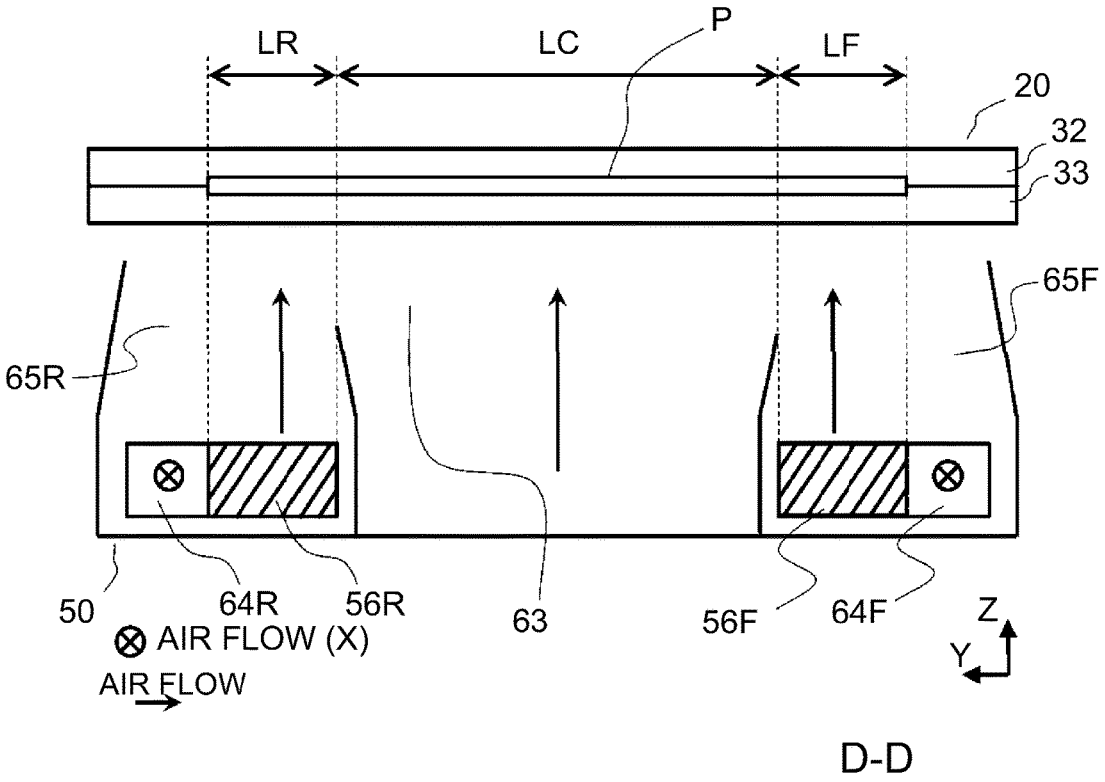

FIG. 13 is a schematic sectional view of the combination shown in FIG. 9, at a plane D-D in FIG. 9.

Figure 14:
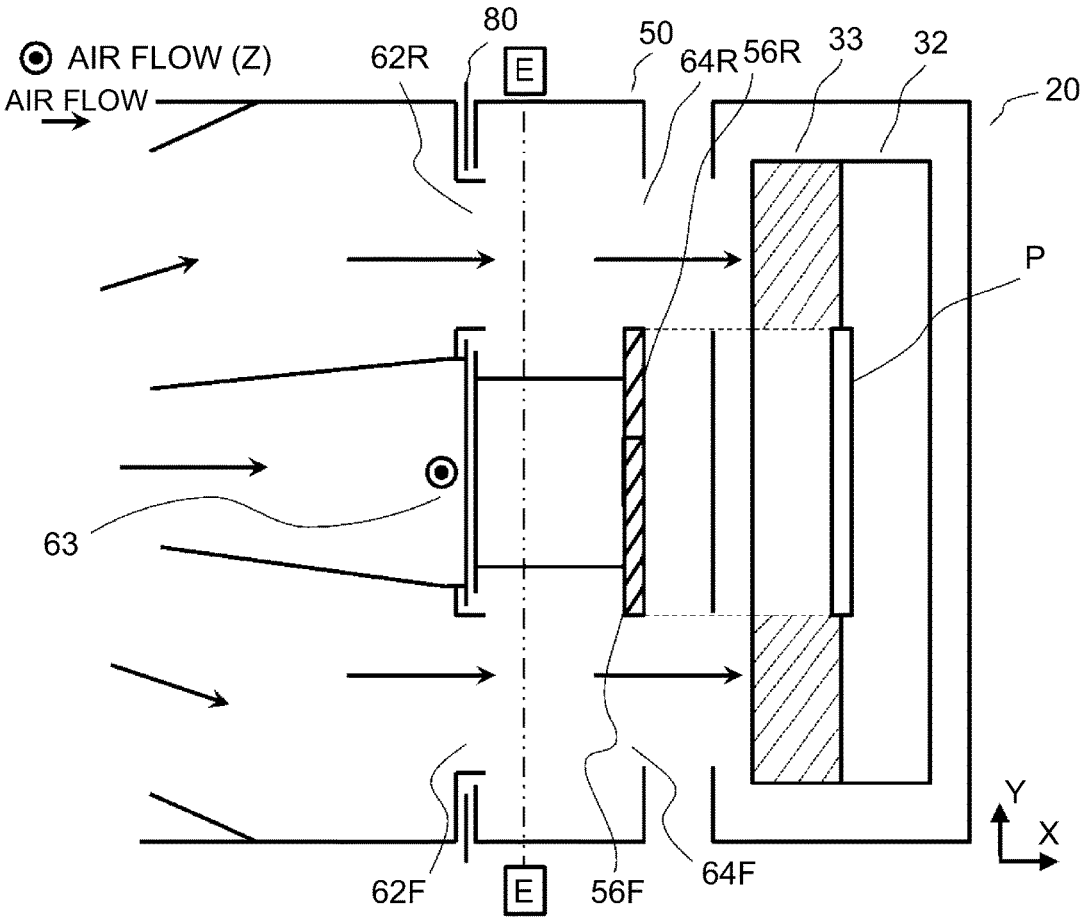

FIG. 14 is a schematic horizontal sectional view of the combination of the fixing mechanism portion, the shutter unit, and a portion of the delivery tray, when the shutter is fully open, and shows the airflow (air paths) from the delivery tray to the fixing apparatus.

Figure 15:
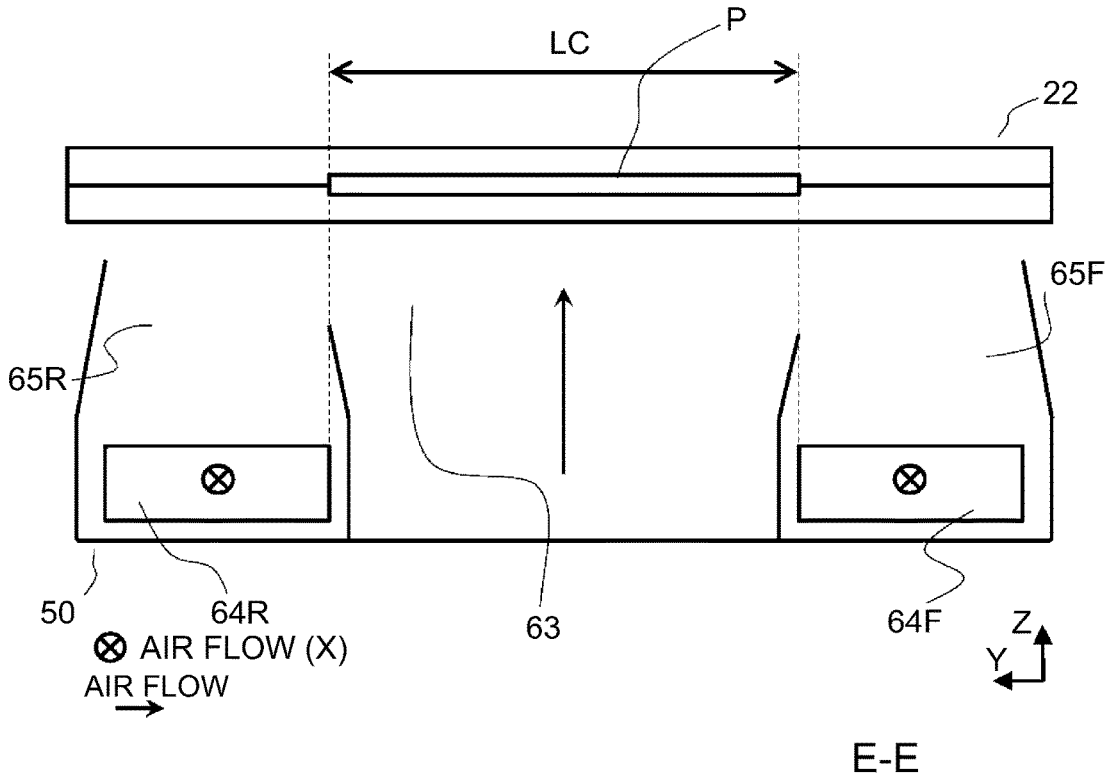

FIG. 15 is a schematic sectional view of the combination shown in FIG. 14, at a plane E-E in FIG. 14.

Figure 16:
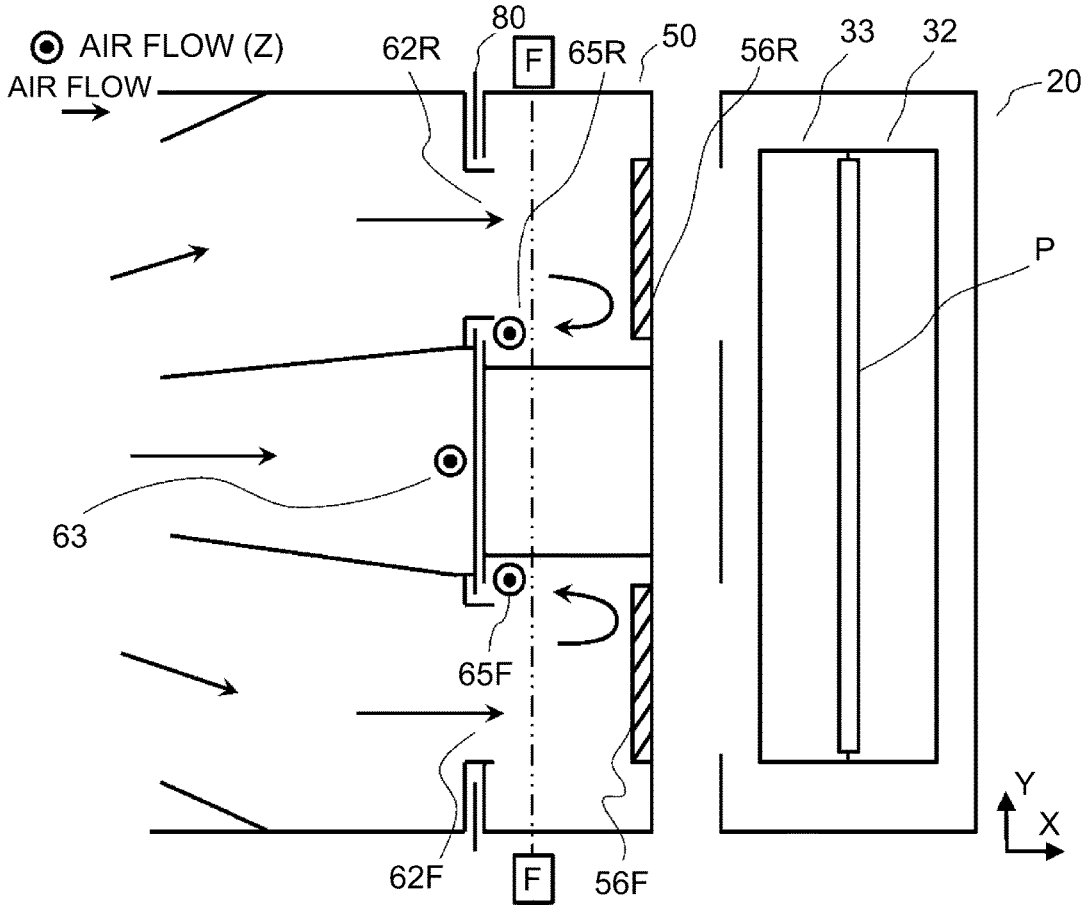

FIG. 16 is a schematic horizontal sectional view of a combination of the fixation mechanism portion, the shutter unit, and a portion of the delivery tray, at a plane that is perpendicular to the direction Z, when the shutter remains completely closed, and shows the airflow (air paths) from the delivery tray to the fixing apparatus.

Figure 17:
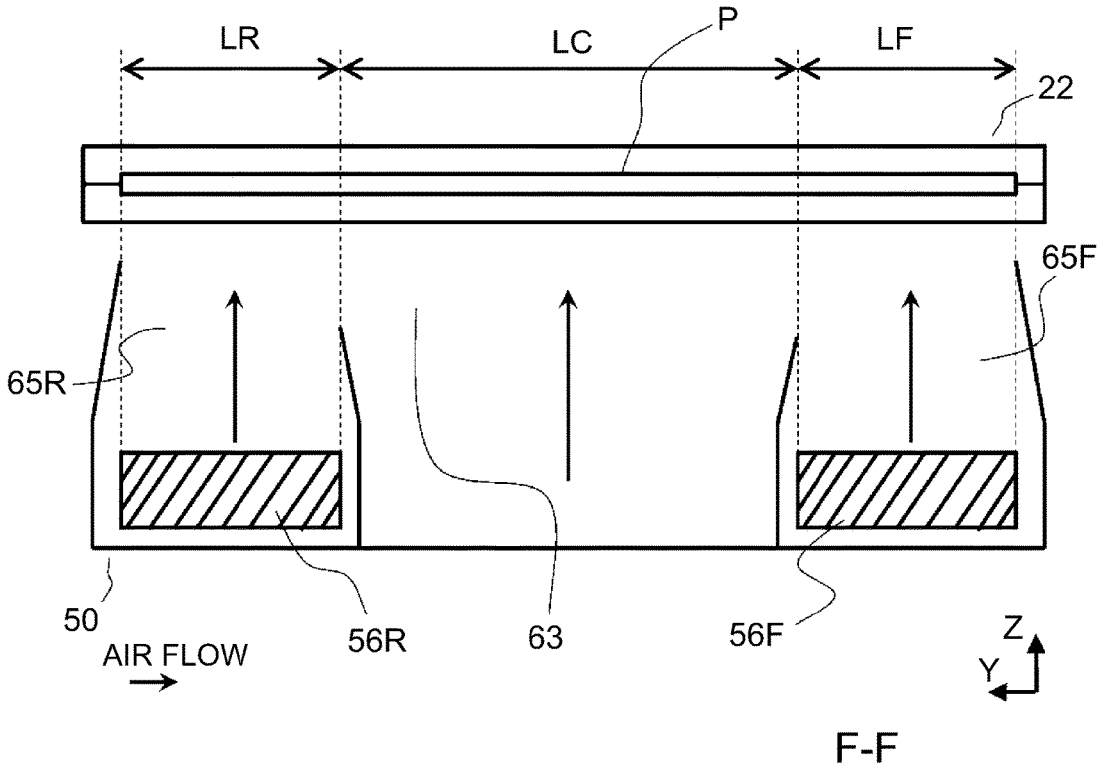

FIG. 17 is a schematic sectional view of the combination shown in FIG. 16, at a plane F-F in FIG. 16.

DESCRIPTION OF THE EMBODIMENTS

Hereafter, the present invention is described in detail with reference to the appended drawings relating to one of the preferred embodiments.

Embodiment 1

Image Forming Apparatus

To begin with, referring to FIG. 1, the image forming apparatus, or a printer 90, in one of the preferred embodiments of the present invention is described with respect to its overall structure. This image forming apparatus 90 is a color laser-beam image forming apparatus, and, more specifically, a full-color laser-beam printer. FIG. 1 is a vertical sectional view of the printer 90, and shows the overall structure of the printer 90. The full-color laser-beam printer 90 has a sheet feeding means 14, which is in the bottom-most portion of the printer 90. The printer 90 has also a registration roller unit 16 that is for registering each sheet P of recording medium. The registration roller unit 16 is on the top-right side of the sheet feeding means 14.

The printer 90 is structured so that four process cartridges 1 (1Y, 1M, 1C, and 1Bk) can be installed above the sheet-feeding means 14. The four process cartridges 1 are provided with four photosensitive drums 2 (2Y, 2M, 2C, and 2Bk), respectively. Further, the printer 90 is provided with an intermediary transfer unit that is on the top side of the space for the process cartridges 1 (1Y, 1M, 1C, and 1Bk). The intermediary transfer unit is provided with an intermediary transfer belt 8. Moreover, the printer 90 is provided with primary transfer rollers 5 (5Y, 5M, 5C, and 5Bk) that are on the inward side of the loop (belt loop) that the intermediary transfer belt 8 forms. Further, the printer 90 is provided with a belt-backing roller 10 and a tension roller 11 that are also on the inward side of the belt loop. Further, the printer 90 is provided with a cleaning means 17 for cleaning the intermediary transfer belt 8.

Moreover, the printer 90 is provided with a secondary transfer unit that is on the right side of the intermediary transfer unit. The secondary transfer unit is provided with a secondary transfer roller 12 that opposes the belt-backing roller 10, with the presence of the intermediary transfer belt 8 between itself and the belt-backing roller 10. There is a fixation mechanism portion 20 (fixation unit) on the top side of the secondary transferring portion, which comprises the secondary transfer roller 12 and the belt-backing roller 10. Further, the printer 90 is provided with a pair of discharge rollers 22 (that makes up sheet-discharging unit), a sheet passage 25 for two-sided image formation mode, a pair of reversal conveyance rollers 24, and a sheet-guiding flapper 26 as a sheet-directing means. The discharge rollers 22, the sheet passage 25, the reversal conveyance rollers 24, and the flapper 26 are on the top-left side of the fixation mechanism portion 20.

The printer 90 is structured so that, as a sheet P of recording medium comes out of the fixation nip of the fixation mechanism portion 20, it is conveyed to a delivery tray 75, through a sheet passage that is adjacent to a cooling fan (cooling blowing means) 53 as an air-blowing means. By the way, a shutter unit 50 as an airflow-blocking member, and the cooling fan 53, which are shown in FIG. 1, are described later in detail.

Fixing Apparatus (1) Fixation Mechanism Portion 20

FIG. 2 is a sectional view of the fixing apparatus (fixing device) mounted in the image forming apparatus 90 in this embodiment of the present invention, and shows the general structure of the fixation mechanism portion 20 of the fixing apparatus. Part (a) of FIG. 3 is a schematic front view of the fixation mechanism portion 20. Part (b) of FIG. 3 is a schematic vertical sectional view of the fixation mechanism portion 20, at a vertical plane that coincides with the axial line of the pressure roller. In the following description of the image forming apparatus 90, in accordance with the present invention, the "lengthwise direction" means the direction that is perpendicular to both the recording medium conveyance direction and the thickness direction of the recording medium. Regarding a sheet P of recording medium, the "widthwise direction" means the direction that corresponds to the "lengthwise" direction of the fixing member, that is, the "lengthwise direction" of the fixing apparatus.

The fixing mechanism portion 20 is a portion of the fixing apparatus that is of the so-called on-demand type. The fixing mechanism portion 20 is structured to heat a sheet P of recording medium and the image thereon through a belt (film), and to drive a rotational pressure-applying roller. Referential codes 31 and 32 in the drawings stand for a film assembly as the first fixing member (heating member), and an elastic pressure roller as the second fixing member (pressure applying member), respectively. The two fixing members 31 and 32 are kept pressed against each other to form a fixation nip N, through which a sheet P of recording medium, which bears a toner image, is conveyed while remaining pinched between the two fixing members 31 and 32.

Regarding the film assembly 31, a referential code 33 stands for a fixation film (a first rotational member, or a film), that is a rotational heating member. The fixation film 33 is cylindrical (an endless belt, or a belt in the form of sleeve), and is flexible. Designated by a referential code 34 is a film guide (a heater-holding member, which functions also as film-guiding member), which is in the form of a trough that is semicircular in cross section. The film guide 34 is heat resistant and rigid. Designated by a referential code 35 is a ceramic heater (that hereafter is referred to simply as a heater) as a heat source (heating member). The heater 35 is fixed to the film guide 34 by being fitted in a groove with which the film guide 34 is provided. The groove is roughly U-shaped in cross section and extends in the lengthwise direction the film guide 34. The film 33 is loosely fitted around the film guide 34, by which the heater 35 is held.

Referring to parts (a) and (b) of FIG. 3, a referential code 36 stands for a pressure stay, which is rigid and U-shaped in cross section, and is provided on the inward side of the film guide 34. A referential code 36*a* stands for the lengthwise end portions (left and right end portions) of the pressure stay 36. A referential code 37 stands for each of a pair of end holders, with which the lengthwise end portions (arm portions) of the pressure stay 36 are fitted. A referential code 37*a* stands for each of a pair of integral flange portions of the holder 37. The fixing apparatus is structured so that the film assembly 31 is parallel to the pressure roller 32 (or the second rotational member), and the heater side of the film assembly 31 faces the pressure roller 32 (or the second rotational member). Further, there are provided a pair (left and right) of compression springs 40, between the left and right end holders 37, and a pair (left and right) of spring seats 39, respectively. The pair of compression springs 40 are kept compressed.

Thus, a combination of the pressure stay 36, the film guide 34, and the heater 35 remains pressed toward the pressure roller 32. Therefore, the heater 35 remains pressed against the pressure roller 32 by the pressure generated by the pair of compression springs 40, with the presence of the film 33 between the heater 35 and the pressure roller 32. Thus, the fixation nip N, which is necessary for thermal fixation, and has a preset width in terms of the recording medium conveyance direction, is formed between the film 33 and the pressure roller 32.

As a sheet P of recording medium is introduced into the fixation nip N, the sheet P is conveyed by the rotating pressure roller 32 while remaining pinched between the pressure roller 32 and the film 33. In this embodiment, the fixing apparatus is structured so that when the sheet P is conveyed through the fixing apparatus, the center of the sheet P, in terms of the widthwise direction, coincides with center of the fixing apparatus. That is, the apparatus is structured so that when a sheet P of recording medium is conveyed through the fixing apparatus, the center of the sheet P, in terms of the widthwise direction, coincides with the widthwise center of the film 33, regardless of sheet width. Referring to part (a) of FIG. 3, a referential code S stands for the referential centerline (hypothetical line) in terms of the widthwise direction of the sheet P.

Referring to parts (a) and (b) of FIG. 3, designated by a referential code W1 is the path of the widest sheet P of recording medium conveyable through the fixing apparatus. In this embodiment, the path W1 is 320 mm in width and corresponds to the width of a sheet P of recording medium of size A3 (SRA3 in portrait mode). The width A of the heat generation range of the heater 35, in terms of the lengthwise direction, is slightly greater than the width of the path W1. A referential code W3 stands for the path of the narrowest sheet P of recording medium conveyable through the fixing apparatus. In this embodiment, the width of the path W3 is 100 mm and corresponds to the width of a postcard (postcard in portrait mode).

A referential code W2 stands for the path of a sheet P of recording medium, the width of which is between the widest and narrowest sheets P of recording medium conveyable through the fixing apparatus (i.e., a recording medium of an intermediary size). In this embodiment, the sheet path W2 is 279.4 mm wide and corresponds to the width of a LTR size sheet P of recording medium (LTR in landscape mode). Hereafter, a sheet P of recording medium, the width of which corresponds to the widest sheet path W1 is referred to as the largest sheet P of recording medium, whereas a sheet P of recording medium that is narrower than the largest sheet P of recording medium is referred to as a small sheet P of recording medium.

A referential code a stands for the area between one of the edges of the path W1 of the largest sheet P of recording medium, and the corresponding edge of the path W2 of a sheet P of recording medium of the intermediary size ($a=(W1-W2)/2$). A referential code b stands for the area between one of the edges of the path W1 of the widest sheet P of recording medium conveyable through the fixing apparatus, and the corresponding edge of the path W3 of the narrowest sheet P of recording medium conveyable through the fixing apparatus ($b=(W1-W3)/2$). That is, the areas a and b stand for the out-of-sheet-path portions that exist as a sheet P of recording medium, which is smaller in width than the widest sheet P of recording medium conveyable through the fixing apparatus, for example, a sheet P of recording medium of a size B4, A5, or the like, is conveyed through the fixing apparatus. In this embodiment, the fixing apparatus is structured so that when a sheet P of recording medium is conveyed, the widthwise center line S of the sheet P coincides with the widthwise centerline of the recording medium passage. Therefore, the out-of-sheet-path portions a and b exist on both sides of the paths W2 and W3, in terms of the widthwise direction. The width of each of the out-of-sheet-path portions a and b is affected by the width of a sheet P of recording medium conveyed through the fixing apparatus.

Referring to FIG. 4, as a heat generating layer, with which a substrate of the heater 35 is provided, is supplied with electrical power by a heater-driving circuit 92 as an electrical power supplying portion, the heater 35 quickly increases in temperature across the entirety of its heat generation range in terms of the lengthwise direction. The temperature of the film 33 is detected by a main thermistor TH1, and the temperature of the heater 35 is detected by a sub-thermistor TH2. Based on the outputs of the main thermistor TH1 and the sub-thermistor TH2, a control portion 100 decides how the heater 35 is to be controlled in temperature, and controls the electrical power supply from the heater-driving circuit 92 to the heater 35.

A control circuit portion, as the control portion 100, drives a fixation motor M1 while controlling a fixation-motor-driving circuit 91 based on the print signals from an external host apparatus, or other control signals. Thus, the pressure roller 32 is rotationally driven. Therefore, the film 33 is rotated by the rotation of the pressure roller 32. Further, the control circuit portion 100 controls the heater-driving circuit 92 to make the heater 35 increase in temperature.

As the film 33 becomes stable in rotational speed, and the heater 35 becomes stable in temperature at a preset level, a sheet P of recording medium, which bears an unfixed toner image, is introduced into the fixation nip N, from the image forming portion side of the fixing apparatus, in such an attitude that the toner image bearing surface of the sheet P faces the film 33. While the sheet P is conveyed through the fixation nip N, the film 33 moves with the sheet P, and the sheet P is kept pressed against the pressure roller 32 by the fixation mechanism portion 20, with the presence of the film 33 between the sheet P and the heater 35.

While the sheet P is conveyed through the fixation nip N, heat is given to the sheet P from the film 33, which is being heated by the heater 35. Further, the sheet P and the toner image T thereon are subjected to the fixation nip pressure. Thus, the toner image T becomes fixed (thermal fixation) to the surface of the sheet P. After being conveyed through the fixation nip N, the sheet P is separated from the surface of the film 33, and is conveyed further to be discharged from the image forming apparatus 90.

(2) Cooling Mechanism Portion

Next, the cooling mechanism portion of the image forming apparatus 90 in this embodiment, which is for cooling the fixing apparatus, is described with respect to its portion for cooling the lengthwise end portions of the fixing apparatus, and its portion for cooling a sheet P of recording medium as the sheet P comes out to be discharged into the delivery tray 75 of the image forming apparatus 90. FIG. 5 is a schematic drawing of the cooling air paths in the delivery tray 75. FIG. 9 is a schematic sectional view of a combination of the fixation mechanism portion 20, the shutter unit 50, and a portion of the delivery tray 75, at a plane that is perpendicular to the direction Z in FIG. 8, when a shutter of the shutter unit 50 is completely shut, and shows the airflow (air paths) from the delivery tray 75 to the fixing apparatus. The body of cooling air from the cooling fan 53 is sent into the delivery tray 75. Then, the body of cooling air is separated into three bodies of airstream by divider ribs provided in the delivery tray 75.

Referring to FIG. 9, a front opening 62F, shown in FIG. 5, is in connection to the air passage from the cooling fan 53 to the shutter unit 50. A center opening 63, shown in FIG. 5, is positioned so that the air from the cooling fan 53 flows in the directions X and Y, which are perpendicular to the direction Z (that is perpendicular to the plane shown FIG. 9). Referring also to FIG. 9, a rear opening 62R, shown in FIG. 5, is in connection to the air passage from the cooling fan 53 to the shutter unit 50.

In this embodiment, the front and rear openings 62F and 62R function as a pair of first air outlets, through which the air (wind) from the cooling fan 53 flows to a first area of the fixing member in terms of the lengthwise direction. A central opening 63 functions as a second air outlet, through which the air (wind) from the cooling fan 53 flows to a second area (central area) of a sheet P of recording medium, in terms of the widthwise direction of the sheet P.

In this embodiment, the direction in which the air (wind) from the cooling fan 53 flows through the second air outlet, and a third air outlet (air flows to third area, which is on the outer side of second area, in terms of widthwise direction of sheet P of recording medium), is such a direction that is intersectional (perpendicular) to the direction in which the air flows through the first air outlet. Further, each of the air passage from the cooling fan 53, as an airflow generating means, to the first air outlet, and the air passage from the cooling fan 53 to the third air outlet, branches.

Next, the shutter unit 50 is described. The shutter unit 50 in this embodiment is provided with a blocking member that not only blocks the area other than the first areas, to form the first areas, which are the lengthwise end portions of the film 33, but also, changes the openings 62R, 62L, and 63 in dimension according to the size of a sheet P of recording medium in terms of the widthwise direction of the sheet P.

FIG. 6 is a schematic drawing of the shutter unit 50, as seen from the fixation mechanism portion side, when the shutter unit 50 is open. The shutter unit 50 is provided with front and rear shutters 56F and 56R, respectively, which are movable in the front-rear direction (Y/−Y direction) by a driving force inputted through a pinion gear 58 that is connected to a shutter motor M2. The amount by which the shutter unit 50 is open is sensed by a sensor 61.

FIG. 7 is a schematic drawing of the shutter unit 50, as seen from the fixation mechanism portion side, when the shutter unit 50 is open by a preset amount, in contrast to FIG. 6. When the shutter unit 50 is in the state shown in FIG. 7, front and rear openings 64F and 64R, respectively, of the shutter unit 50 have been widened by the movement of the front and rear shutters 56F and 56R, respectively, making it possible for the air to flow through the front and rear openings 64F and 64R.

FIG. 8 is a schematic drawing of the shutter unit 50, as seen from the opposite side (delivery tray side) of the shutter unit 50, when the shutter unit 50 is in the state shown in FIG. 7. In terms of the lengthwise direction, the shutter unit 50 has three sections. The first section, or the right section (or a front side of the main assembly of the fixing apparatus) in FIG. 8, is in connection to the front opening 62F (FIG. 9) of the delivery tray 75 (FIG. 1). There is an opening above the first section (in direction Z), which is an opening 65F for cooling a sheet P of recording medium before the sheet P is discharged into the delivery tray 75. The opening 65F is on a lengthwise end side of the central opening 63. The center section, or the center portion (of the main assembly of the fixing apparatus) in the drawing, is provided with the shutter motor M2 (FIG. 8).

Further, the third section, or the left portion of the shutter unit 50 in FIG. 8, is in connection to the rear opening 62R (FIG. 9) of the delivery tray 75. There is an opening above the third section, which is an opening 65R for cooling a sheet P of recording medium before the sheet P enters the delivery tray 75. In this embodiment, the opening 65F and 65R function as the third air outlets through which the air (wind) from the cooling fan 53 flows.

FIGS. 10 to 13 are schematic sectional views of a combination of the fixation mechanism portion 20, the shutter unit 50, and a portion of the delivery tray 75, at planes A-A, B-B, C-C, and D-D, respectively, in FIG. 9. The size of each opening of the shutter unit 50 corresponds to the state in which a sheet P of recording medium of the LTR size is conveyed in the landscape mode (recording medium dimension is 279.4 mm in width). Referring to FIGS. 9 and 10, the airflow for cooling the front side of one (front side) of the widthwise end portions of the film 33 (first rotational member), as the fixing member, which faces toward the cooling fan 53 (FIG. 1), is described.

As the cooling air is sent into the delivery tray 75 by the cooling fan 53, it is sent to the shutter unit 50 through the front opening 62F of the delivery tray 75. When the combination of the fixation mechanism portion 20, the shutter unit 50, and a portion of the delivery tray 75 is in the state shown in FIGS. 9 and 10, the front shutter 56F has been moved by a preset amount. Therefore, the front opening 64F is unblocked. Therefore, the cooling air is allowed to blow on the film 33 through the front opening 64F, to cool the front end portion (out-of-sheet-path portion) of the film 33 (first rotational member) in terms of the lengthwise direction.

Referring again to FIG. 9, as a body of air flows into the delivery tray 75 through the front opening 62F of the tray 75, a portion of the body of air is blocked by the front shutter 56F, while the rest of the body of air is guided into the front opening 65F of the shutter unit 50. That is, the front opening 65 is in the position in which it accommodates the body of air that came through the front opening 62F. Therefore, the portion of the body of air blocked by the front shutter 56F is blown through the opening 65F (FIG. 11) provided above the shutter unit 50, toward the front end portion of a sheet P of recording medium, in terms of the widthwise direction, and cools the sheet P, as the sheet P is discharged into the delivery tray 75 by the pair of discharge rollers 22.

The path of the airflow for cooling the rear end portion of the fixing member in terms of the lengthwise direction is symmetrical to the path of the airflow for cooling the front end portion of the fixing member in terms of the lengthwise direction, with reference to the centerline of the main assembly of the image forming apparatus 90. That is, referring to FIG. 9, as a body of air flows into the shutter unit 50 through the rear opening 62R of the delivery tray 75 portion of the body of air is blocked by the rear shutter 56R, while the rest of the body of air is made to flow toward the rear opening 65R with which the shutter unit 50 is provided. That is, the shutter unit 50 is structured so that its opening 65R is positioned to take in the portion of the airflow that was not blocked by the rear shutter 56R. Therefore, the portion of the airflow blocked by the rear shutter 56R is made to blow at the rear end portion of the sheet P of recording medium, through the opening 65R, thereby cooling the sheet P, as the sheet P is discharged by the pair of discharge rollers 22 (FIG. 1).

As for the body of cooling air that flows through the lengthwise center portion of the delivery tray 75, it flows upward (in direction Z) with respect to the main assembly, through the central opening 63 (FIG. 9). Then, the body of cooling air advances through the space between the delivery tray 75 and a frame 80 of the main assembly of the image forming apparatus 90. Thus, the body of cooling air blows upon the center portion of a sheet P of recording medium, in terms of the widthwise direction, as the sheet P is discharged by the pair of discharge rollers 22. Thus, the body of cooling air can cool the center portion of the sheet P.

FIG. 13 is a schematic sectional view of a combination of the pressure roller 32, the film 33, and the shutter unit 50, at a plane X, or a plane that is perpendicular to the direction X. FIG. 13 shows how and where the cooling air hits a sheet P of recording medium as the sheet P is discharged by the pair of discharge rollers 22 (FIG. 1). As described above, when the shutter unit 50 is in the state shown in FIG. 13, the front shutter 56F and the rear shutter 56R are in positions into which they have been moved to accommodate a sheet P of recording medium of the LTR size (279.4 mm in landscape mode). Thus, the cooling air flows toward the end portions of the film 33 (in plane X) in terms of the lengthwise direction, through the front opening 64F and the rear opening 64R.

As for the portion of the body of cooling air that was blocked by the front shutter 56F and the rear shutter 56R, it flows toward the sheet P through the front opening 65F and the rear opening 65R. Further, the cooling air flows to the sheet P through the central opening 63. Thus, there is the following relationship among an area LF, in which the sheet P is cooled by the cooling air discharged through the front opening 65F, an area range LC, in which the sheet P is cooled by the cooling air discharged through the central opening 63, and an area LR, in which the sheet P is cooled by the cooling air discharged through the rear opening 65R: LF+FR+LC=279.4 mm.

Next, a case in which the front opening 64F and the rear opening 64R are fully open is described. FIG. 14 is a schematic sectional view of a combination of the fixation mechanism portion 20, the shutter unit 50, and the upstream portion of the delivery tray 75, in terms of the recording medium conveyance direction, at a horizontal plane that is perpendicular to the direction Z, when the shutter is open by the amount for accommodating a postal envelope fed in the landscape mode (when a sheet P of recording medium that is 165 mm in width is fed). FIG. 15 is a schematic sectional view of the combination, at a plane E-E in FIG. 14.

Referring to FIG. 14, the airflow for cooling the front end portion of the fixing member, in terms of the lengthwise direction, is described. As the cooling air is blown into the delivery tray 75 by the cooling fan 53 (FIG. 1), it is sent to the shutter unit 50 through the front opening 62F of the delivery tray 75. The front shutter 56F is fully open. Thus, as the cooling air is sent into the shutter unit 50, all of the cooling air flows to the out-of-sheet-path portions of the film 33, which are greater in temperature than the sheet-path portion of the film 33. The path of the airflow for cooling the rear end portion of the fixing member in terms of the lengthwise direction, is symmetrical to the path of the airflow for cooling the front end portion of the fixing member in terms of the lengthwise direction.

Further, the body of cooling air that flows through the center opening 63 is not affected by the shutter opening. Therefore, the body of cooling air flows toward the sheet P of recording medium, as described above. Thus, it is only the body of cooling air that is discharged through the center opening 63, as shown in FIG. 15, that cools a sheet P of recording medium when the sheet P is a postal envelope and is conveyed in the landscape attitude.

Referring to FIG. 15, the area LC, which is cooled by the body of air discharged from the center opening 63, is set to be the same in width as the area between the front opening 64F and the rear opening 64R when the two openings 64F and 64R are fully open (exposed). Therefore, the body of cooling air that is discharged through the center opening 63 can cool the sheet P of recording medium (postal envelope) across its entire range in terms of the widthwise direction. In this case, the width of the area LC is 165 mm (LC=165 mm). Further, in a case in which recording medium is a small sheet P of paper (when a postcard is conveyed in portrait attitude (100 mm in widthwise direction), for example), LC>100 mm. Therefore, the recording medium can be cooled across its entire range in terms of the widthwise direction.

In this embodiment, the area in terms of the widthwise direction, across which recording medium can be cooled by the body of air that is discharged from the second outlet, is not narrower than the area, in terms of the lengthwise direction of the fixing member, across which the fixing member is not cooled by the first outlet when the blocking member is fully open.

Next, a case in which the front opening 64F and the rear opening 64R remain completely closed is described. FIG. 16 is a schematic sectional view of a combination of the fixation mechanism portion 20, the shutter unit 50, and the upstream end portion of the delivery tray 75 in terms of the recording medium conveyance direction, at a plane that is perpendicular to the direction Z, when a sheet P of recording medium (which is 320 mm in width) of a size SRA3 is conveyed in the portrait mode. FIG. 17 is a schematic sectional view of the combination at a plane F-F in FIG. 16. Referring to FIGS. 16 and 17, the flow of the body of air for cooling the front end portions of the film 33 (first rotational member), as a fixing member, which is on the cooling fan side (FIG. 1), is described.

As cooling air is blown into the delivery tray 75 by the cooling fan 53, it is sent to the shutter unit 50 through the front opening 62F of the delivery tray 75. Since the front shutter 56F is completely closed, the cooling air is entirely blocked by the front shutter 56F, and, therefore, does not flow toward the film 33. As the cooling air flows, it flows toward the opening 65F (FIG. 11) for cooling a sheet P of recording medium as the sheet P comes out of the nip between the pair of discharge rollers 22, and is then blown at the sheet P to cool the sheet P as the sheet P comes out of the nip N.

The path of the body of air for cooling the rear end portion of the film 33 (first rotational member) in terms of the lengthwise direction is symmetrical (similar) to the path of the body of air for cooling the front end portion of the film 33. As for the body of cooling air that flows through the center opening 63, it is not affected by the shutter opening, and, therefore, flows toward the sheet P.

Referring to FIG. 17, there are three bodies of air, that is, the body of air that is discharged through the center opening 63, the body of air that is discharged through the front opening 65F, and the body of air that is discharged through the rear opening 65R, that cool a sheet P of recording medium. The shutter unit 50 is structured so that the width of the front opening 65F and the width of the rear opening 65R correspond to the widest sheet P of recording medium conveyable through the fixing apparatus (image forming apparatus). Therefore, a combination of the bodies of cooling air discharged through the center, rear, and front openings 63, 65F, and 65R, one for one, can cool the sheet P across the entire area of the sheet P. In this case, LF+LR+LC=320 mm.

As described above, in this embodiment, in order to prevent the out-of-sheet-path portions of the fixing members from excessively increasing in temperature, the shutter unit 50 is structured so that the front and rear shutters 56F and 56R, respectively, of the shutter unit 50 are movable to control the flow of cooling air. That is, the shutter unit 50 is structured so that its front and rear shutters 56F and 56R, respectively, are changeable in position, in terms of the lengthwise direction, to change the shutter unit 50 in the range (cooling range), in terms of the lengthwise direction, in which the cooling air from the cooling fan 53 for cooling the widthwise end portions of a sheet P of recording medium, as the sheet P is discharged from the fixing device, flows. More specifically, as the shutter is opened wide (when a smaller sheet P of recording medium is conveyed), it is reduced in the size of the area for cooling the widthwise end portions of the sheet P (area is abolished). On the contrary, when the shutter is small in the size of its opening (when a larger size sheet P of recording medium is conveyed), the range across which the widthwise end portions of a sheet P of recording medium are cooled is greater.

As described above, this embodiment makes it possible to provide a low-cost mechanism that can cool a sheet P of recording medium across the entire range of the sheet P, regardless of sheet size, without employing an unconventional sensor and/or mechanism. That is, according to this embodiment, only one shutter unit 50 was employed. The shutter unit 50 is provided, however, with a pair of shutters that are changeable in position according to recording medium size, being, therefore, capable of cooling not only the out-of-sheet-path portions of the fixing members, but also of controlling the shutter unit 50 in the cooling range in terms of the lengthwise direction. That is, not only can this embodiment make it possible to prevent the out-of-sheet-path portions of the fixing members from excessively increasing in temperature, but also, this embodiment provides a cooling mechanism that is capable of efficiently cooling a sheet P of recording medium regardless of the size of the sheet Pin terms of the widthwise direction.

Moreover, the shutter unit 50 was structured so that the cooling air outlet, which is not affected by the shutter opening, is across the center portion of the shutter unit 50, and also, so that, in terms of the widthwise direction, the sum of the width of the central opening, the front opening, and the rear opening becomes the same as the dimension of a sheet P of recording medium in terms of the widthwise direction. Therefore, it is possible to uniformly cool a sheet P of recording medium across the entirety of the sheet P, even if the sheet P happens to be of the large size.

Modification

In the foregoing description, the present invention was described with reference to one of the preferable embodiments of the present invention. The embodiment described above is not, however, intended to limit the present invention in scope. That is, the present invention is also applicable to image forming apparatuses that are different from the one in the embodiment described above, and are within the scope of the gist of the present invention.

Modification 1

In the embodiment described above, the shutter unit 50 was structured so that the cooling air roughly perpendicularly hits a sheet P of recording medium as soon as the sheet P is discharged by the pair of discharge rollers 22. The embodiment, however, is not intended to limit the present invention in scope in terms of the direction in which the sheet P is discharged. For example, in order to cool the sheet P for a longer length of time, the shutter unit 50 may be structured so that the cooling air is directed toward the sheet-bearing-surface of the delivery tray 75 to make the cooling air to hit the sheet P on the delivery tray 75.

Further, the present invention is also applicable to an image forming apparatus structured to guide the cooling air into the main assembly of the apparatus, in order to ensure that the cooling air hits a sheet P of recording medium when the sheet P is highest in temperature, that is, right after the sheet P comes out of the fixing device.

Further, the shutter may be given a curved shape or a tapered shape (in cross section relative to a plane parallel to the sheet P, shown in FIG. 9), in order to facilitate the body of cooling air to be blocked by the shutter and to flow more so to the other openings (center opening, for example) as compared to the embodiment described above. In such a case, it is possible to change the three sections in the amount (cooling amount) by which cooling air is sent to them from the cooling fan 53, without changing the three sections in cooling range in terms of the lengthwise direction in FIG. 13.

That is, the amount by which the cooling air is blocked by the front shutter 56F and the rear shutter 56R, and, therefore, the amount of cooling air that flows toward the sheet P of recording medium through the front opening 65F and the rear opening 65R, reduces. Thus, the amount by which the cooling air from the cooling fan 53 is made to flow toward the sheet P through the center opening 63 increases by the amount that is equal to the amount by which the cooling air is prevented from flowing toward the sheet P through the openings 65F and 65R.

Modification 2

In the case of the embodiment described above, the image forming apparatus was provided with a means for obtaining the information regarding the dimension of a sheet P of recording medium in terms of the widthwise direction, so that the shutter unit 50, as an airflow blocking means, can be changed in its shutter position in terms of the lengthwise direction, based on the obtained information. The means for obtaining the information regarding the dimension of the sheet Pin terms of the widthwise direction may, however, be different from the one used in the preceding embodiment. For example, the image forming apparatus may be provided with a means for obtaining the information regarding the temperature of the film 33, to recognize the areas in which the out-of-sheet-path portions of the fixing member undesirably increase in temperature, so that the shutter unit 50, as the blocking member, can be changed in the size and positioning of its opening in terms of the lengthwise direction.

Modification 3

In the case of the embodiment described above, the second rotational member was the pressure roller. The second rotational member may, however, be in the form of an endless belt, like the first rotational member.

Modification 4

In the case of the embodiment described above, the recording medium was a sheet P of paper. The embodiment is not, however, intended to limit the present invention in scope in terms of recording medium. Generally speaking, the recording medium is a sheet P of a substance on which a toner image can be formed by the image forming apparatus 90. The recording medium includes a sheet P of ordinary paper, cardstock, thin paper, resin, glossy paper, or overhead projector (OHP) film, which has a specific shape, or no specific shape, for example. The recording medium also includes also a seal, an envelope, a postcard, and the like. By the way, in the case of the embodiment described above, the handling of a sheet P of recording medium was described with the use of such terminologies as "sheet passage," "sheet discharge," "out-of-sheet-path," and the like, for convenience sake. The embodiment is not, however, intended to limit the present invention in scope in terms of recording medium.

Modification 5

In the case of the embodiment described above, the fixing apparatus was an apparatus for fixing an unfixed toner image to a sheet P of recording medium. The embodiment is not, however, intended to limit the present invention in scope in terms of fixing apparatus selection. For example, the present invention is also applicable to an apparatus (that also is referred to as fixing apparatus) for applying heat and pressure to a toner image, which has been temporarily fixed to a sheet P of recording medium, in order to improve the toner image in glossiness.

While the present invention has been described with reference to exemplary embodiments, it is to be understood that the invention is not limited to the disclosed exemplary embodiments.

What is claimed is:

1. An image forming apparatus comprising:

an image forming portion configured to form an image on a recording material;

a fixing device having a nip, and configured to fix the image on the recording material while nipping and feeding the recording material on which the image is formed;

a cooling fan configured to feed air;

a first blow portion through which the air fed by said cooling fan flows toward a first area, which is an end portion of said fixing device, in a longitudinal direction of said fixing device, so as to cool the first area by the air via an opening of said first blow portion;

a blocking member configured to change a width of the opening of said first blow portion; and a second blow portion, branched from said first blow portion so as to cross said first blow portion, through which the air blocked by said blocking member flows toward a second area, which is a region the recording material passes through said nip.

2. The image forming apparatus according to claim 1, further comprising an air feeding path from said cooling fan to said first blow portion.

3. The image forming apparatus according to claim 1, wherein the second area is in a central region in the longitudinal direction.

4. The image forming apparatus according to claim 1, wherein said blocking member changes the width of the opening of said first blow portion in accordance with a length, measured in a widthwise direction, of the recording material.

5. The image forming apparatus according to claim 1, wherein said fixing device includes a fixing member, wherein said apparatus further comprises a thermistor configured to acquire information of a temperature of said fixing member, and wherein said blocking member changes the width of the opening of said first blow portion in accordance with an output of said thermistor.

6. The image forming apparatus according to claim 1, wherein, in the longitudinal direction, a cooling region of the recording material cooled by the air from said cooling fan is greater than a non-cooling region of said fixing member not cooled by the air from said cooling fan when said blocking member does not change the width of the opening of said first blow portion.

7. The image forming apparatus according to claim 1, further comprising a third blow portion through which the air from said cooling fan flows toward the second area so as to cool the second area regardless of the position of said blocking member, wherein, in the longitudinal direction, said second blow portion is located further outward from a center of said fixing device than said third blow portion.

* * * * *